US008453721B2

(12) United States Patent
Mathur et al.

(10) Patent No.: US 8,453,721 B2
(45) Date of Patent: Jun. 4, 2013

(54) SEALS FOR A STACKED-PLATE HEAT EXCHANGER

(75) Inventors: Achint P. Mathur, Wichita Falls, TX (US); Cesar M. Romero, Wichita Falls, TX (US)

(73) Assignee: Tranter, Inc., Wichita Falls, TX (US)

( * ) Notice: Subject to any disclaimer, the term of this patent is extended or adjusted under 35 U.S.C. 154(b) by 1414 days.

(21) Appl. No.: 12/022,937

(22) Filed: Jan. 30, 2008

(65) Prior Publication Data

US 2008/0179049 A1 Jul. 31, 2008

Related U.S. Application Data

(60) Provisional application No. 60/887,446, filed on Jan. 31, 2007.

(51) Int. Cl.
*F28F 3/00* (2006.01)
*F28F 3/08* (2006.01)
*F28F 9/22* (2006.01)

(52) U.S. Cl.
USPC ..... 165/157; 165/135; 165/145; 165/159; 165/160; 165/161; 165/167

(58) Field of Classification Search
USPC ..... 165/157, 167
See application file for complete search history.

(56) References Cited

U.S. PATENT DOCUMENTS

| | | | | |
|---|---|---|---|---|
| 3,811,495 | A * | 5/1974 | Laing | 165/85 |
| 4,548,260 | A * | 10/1985 | Stachura | 165/160 |
| 4,732,713 | A | 3/1988 | Korsell | |
| 5,078,209 | A | 1/1992 | Kerkman et al. | |
| 5,088,552 | A | 2/1992 | Raunio | |
| 5,146,980 | A | 9/1992 | Le Gauyer | |
| 5,327,958 | A | 7/1994 | Machata et al. | |
| 5,823,253 | A | 10/1998 | Kontu | |
| 5,832,736 | A | 11/1998 | Yoshioka et al. | |
| 6,016,865 | A | 1/2000 | Blomgren | |
| 6,131,648 | A | 10/2000 | Rasmussen | |
| 6,918,433 | B2 * | 7/2005 | Kontu | 165/160 |
| 6,932,151 | B2 * | 8/2005 | Galtz | 165/58 |
| 7,004,237 | B2 * | 2/2006 | Mathur et al. | 165/82 |
| 7,204,300 | B2 | 4/2007 | Kontu et al. | |
| 2003/0000688 | A1 * | 1/2003 | Mathur et al. | 165/167 |
| 2006/0118284 | A1 | 6/2006 | Tauren et al. | |

FOREIGN PATENT DOCUMENTS

| | | | |
|---|---|---|---|
| DE | 19654776 | A1 * | 7/1998 |
| WO | WO 97/45689 | | 12/1997 |

* cited by examiner

*Primary Examiner* — John Ford
(74) *Attorney, Agent, or Firm* — Reising Ethington P.C.

(57) ABSTRACT

A stacked plate heat exchanger includes a core having an outer periphery and a longitudinal axis, a shell having an inner periphery and at least partially surrounding the core to define a fluid gap therebetween. A seal between the shell and the core at least partially divides the fluid gap into an inlet chamber and an outlet chamber, and includes at least one core fin projecting generally radially outwardly and having at least one core fixed end proximate the outer periphery of the core and at least one core free end distal the outer periphery of the core, and also includes at least one shell fin projecting generally radially inwardly and having at least one shell fixed end proximate the inner periphery of the shell and at least one shell free end distal the inner periphery of the shell, and being interleaved with the at least one core fin.

8 Claims, 6 Drawing Sheets

SEALS FOR A STACKED-PLATE HEAT EXCHANGER

CROSS-REFERENCE TO RELATED APPLICATION(S)

This application claims the benefit of U.S. Provisional Application No. 60/887,446, filed Jan. 31, 2007, the content of which is incorporated herein by reference in its entirety.

FIELD OF THE INVENTION

The present invention relates generally to heat exchangers and, more particularly, to seals for stacked plate heat exchangers.

BACKGROUND OF THE INVENTION

Typical heat exchangers enable transfer of heat from a treatment fluid flowing on one side of a barrier to a working fluid flowing on another side of the barrier. For example, stacked plate heat exchangers include a shell for housing a plurality of corrugated heat transfer plates. The plates are longitudinally arranged face-to-face in a stack. Collectively, the adjacent plates in the stack define transversely extending passages for the treatment fluid that are interdigitated with transversely extending passages for the working fluid. The treatment fluid passages are closed at the outer periphery of the stack and extend across the stack in fluid communication between inlet and outlet passages extending longitudinally through the plates of the stack. In contrast, the working fluid passages also extend across the stack, but are open at the outer periphery of the stack in fluid communication with inlet and outlet chambers between the stack and the shell.

Heat exchanger seals are longitudinally and radially disposed along and between the outer periphery of the stack and the inner periphery of the shell to define the inlet and outlet chambers for the working fluid. The seals direct flow of working fluid from the inlet chamber, across the stack through the working fluid passages, to the outlet chamber. Unfortunately, however, many heat exchanger seals are unnecessarily complex and costly, and render the heat exchanger difficult to assemble.

For example, some heat exchangers are sealed with four curved plates and rubber sealing elements. First, an opposed pair of semi-cylindrical support plates are welded to the outer periphery of the stack, with a pair of similarly curved rubber sheets placed radially between the support plates and the stack. Second, an opposed pair of semi-cylindrical flow plates are welded to end plates of the stack, ninety degrees offset from the pair of support plates. Third, the flow plates include sides that are curved radially inwardly and welded to the support plates. Fourth, the flow plates are radially inwardly compressed toward the stack to allow the shell to be assembled over the stack and in circumferential contact with the outer periphery of the flow plates.

SUMMARY OF THE INVENTION

A stacked plate heat exchanger according to one implementation includes a core having an outer periphery and a longitudinal axis, and a shell having an inner periphery and at least partially surrounding the core to define a fluid gap between the shell and the core. The heat exchanger also includes a seal disposed between the shell and the core to at least partially divide the fluid gap into an inlet chamber and an outlet chamber. The seal includes at least one core fin projecting generally radially outwardly with respect to the core and having at least one core fixed end proximate the outer periphery of the core and at least one core free end distal the outer periphery of the core. The seal also includes at least one shell fin projecting generally radially inwardly with respect to the shell and having at least one shell fixed end proximate the inner periphery of the shell and at least one shell free end distal the inner periphery of the shell, and being interleaved with the at least one core fin.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
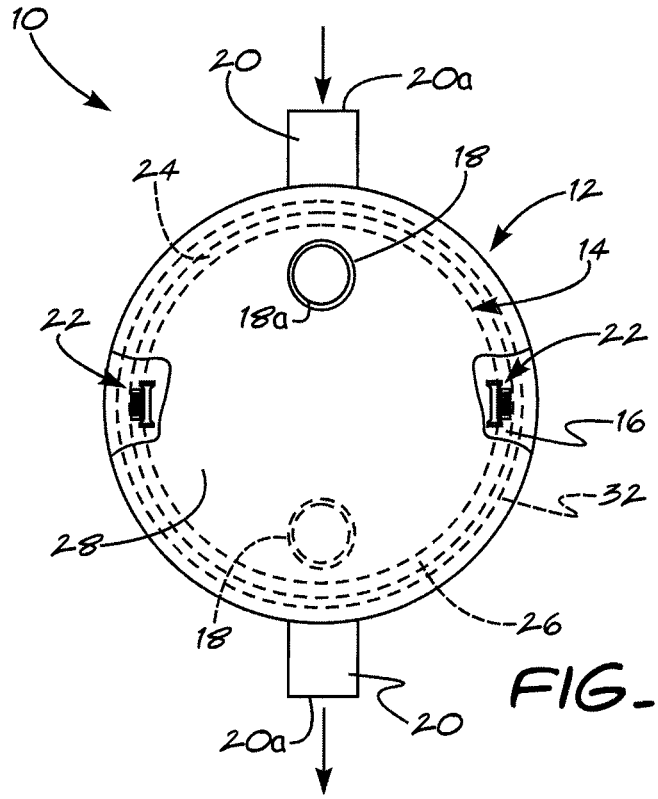
FIG. 1 is a top view of one embodiment of an exemplary stacked plate heat exchanger.
Figure 2:
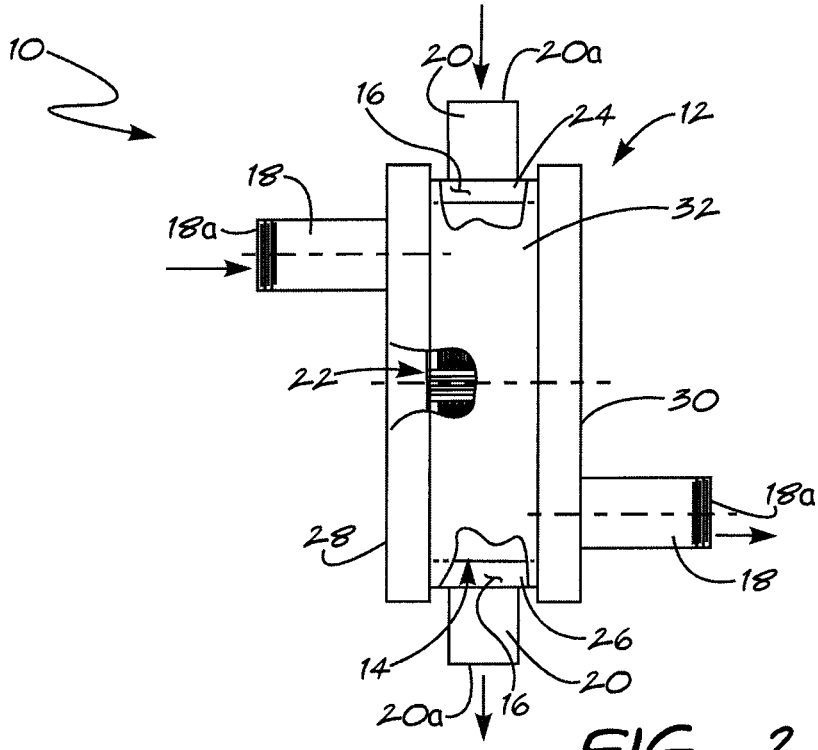
FIG. 2 is a partially fragmentary side view of the heat exchanger of FIG. 1.

Referring in more detail to the drawings, FIGS. 1 and 2 illustrate an exemplary heat exchanger 10 for transfer of heat between different fluids. The heat exchanger 10 may be substantially similar to that disclosed in U.S. Pat. No. 7,004,237, the disclosure of which is incorporated herein by reference in its entirety. Although the heat exchanger 10 is illustrated as being generally cylindrical and relatively short, it can be of any suitable shape and size.

In general, however, the heat exchanger 10 includes a housing 12 defining an interior volume, and a core 14 disposed within the housing 12 for exchanging heat between different fluids, wherein a fluid gap 16 is defined between the core 14 and the housing 12. The core 14 can be any suitable type of heat exchanger core, such as a stacked plate core. The heat exchanger 10 may also include core nozzles or fittings 18 for conveying a treatment or core fluid in and out of the heat exchanger 10, and shell nozzles or fittings 20 for conveying a working or shell fluid in and out of the heat exchanger 10. The heat exchanger 10 further includes one or more labyrinth seals 22 disposed substantially between the core 14 and the housing 12 to divide the fluid gap 16 into inlet and outlet chambers 24, 26 for the shell fluid.

The housing 12 generally provides structural support and defines an interior for the core 14. The housing 12 may include an inlet cover 28, an outlet cover 30, and a shell 32 disposed therebetween. The covers 28, 30 may be plate-like components, and the shell 32 may be an open-ended hollow component preferably of cylindrical shape as shown.

The fittings 18, 20 are adapted to convey treatment and working fluids into and out of the heat exchanger 10, and any suitable quantity and arrangement of fittings may be used. The core fittings 18 may be carried through the covers 28, 30 and the shell fittings 20 may be carried by the shell 32 in any suitable manner, including welding, press-fit, threading, or the like. The core fittings 18 may include fixed ends (not shown) adapted to be in sealed fluid communication with the core 14, and free ends 18*a* adapted to be coupled, for example, to an external treatment fluid source (not shown) having a fluid that requires heating or cooling treatment. The shell fittings 20 may include fixed ends (not shown) adapted to be in general fluid communication with the interior of the housing 12, and free ends 20*a* adapted to be coupled, for example, to a working portion of a heat exchanging system such as a cooler or a heater (not shown). Those skilled in the art will recognize that the fittings 18, 20 and fluids could be reversed such that the shell fluid is a treatment fluid, and the core fluid is a working fluid.

Figure 4:
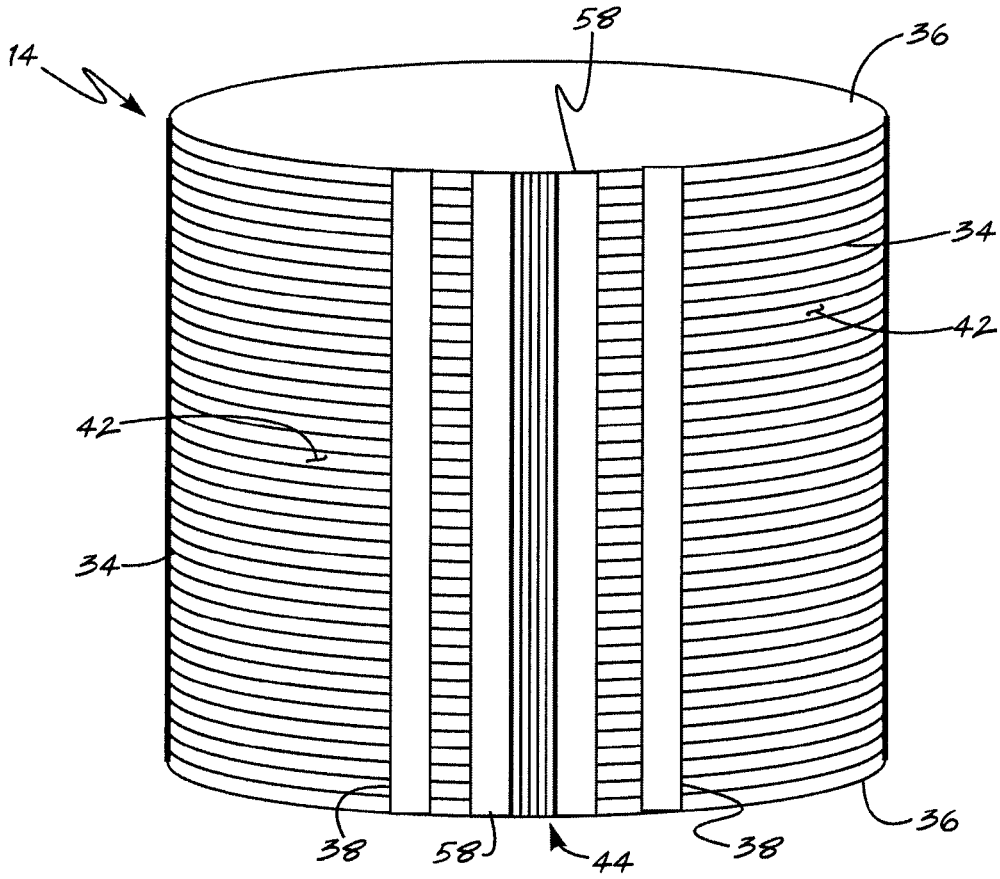
FIG. 4 is an upper perspective view of an exemplary stack of the heat exchanger of FIG. 1, showing an exemplary first portion of the heat exchanger seal.

Referring to FIG. 4, the core 14 generally enables the core and shell fluids to flow in close proximity to one another for beneficial heat transfer therebetween. The core 14 can be any suitable heat exchanger core but, as shown, is preferably a stacked plate type of heat exchanger. The stack, plate pack, or core 14 generally may include a plurality of cassettes 34 for establishing fluid flow through the core 14, end plates 36 for supporting the cassettes 34, and tie straps 38 for securing the end plates 36 to one another. The cassettes 34 may be stacked one atop another between the end plates 36 and welded together in any suitable fashion. Then the stack of cassettes 34 may be compressed somewhat to urge the cassettes 14 into good sealing engagement with one another, and then the tie straps 38 may be welded to the end plates 36, but may be attached in any other suitable fashion, to maintain compression of the stack of cassettes 34.

Figure 6:
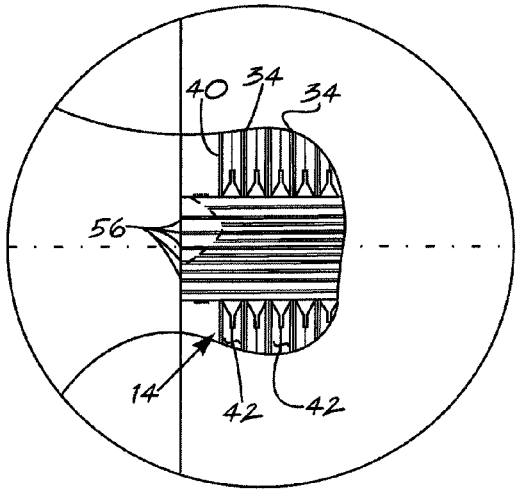
FIG. 6 is an enlarged fragmentary view of a portion of the heat exchanger of FIG. 1.

Referring to FIG. 6, each cassette 34 may include corrugated plates 40 that, in turn, may be welded to one another. The plates 40 may be of large surface area relative to their thickness. Typically, the plates 40 may each have various transverse channels and ridges (not shown) to define fluid passages, and a longitudinal inlet aperture (not shown) at one lateral side and a longitudinal outlet aperture (not shown) at a substantially opposite lateral side. Collectively, the plate apertures may be respectively aligned in the core 14 to define longitudinally extending stack inlet and outlet passages (not shown). Similarly, the plate channels and ridges may be arranged to define core fluid passages extending transversely across the core 14 in general fluid communication with the core inlet and outlet passages. Likewise, the arrangement of the plate channels and ridges may also define shell fluid passages extending transversely across the core, adjacent the core fluid passages, and in fluid communication with the fluid gap 16 (FIG. 3) between the core 14 and housing 12. At the periphery of the core 14, transversely facing peripheral inlet and outlet openings 42 of the shell fluid passages may be defined.

Referring to FIGS. 1 and 3-5, the seals 22 generally divide the fluid gap 16 into the inlet and outlet chambers 24, 26 for the shell fluid, to thereby direct the flow of shell fluid into the core peripheral inlet openings 42 at the inlet chamber 24 and out of stack peripheral outlet openings 42 at the outlet chamber 26. In other words, the core fluid passages are open at the periphery of the core 14, and the seals 22 direct flow of core fluid from the inlet chamber 24, across the core 14 through the core fluid passages, to the outlet chamber 26. The seals 22 extend radially between, and longitudinally along, the core 14 and the shell 32 and may be carried thereby in any suitable fashion. Each seal 22 may include a core portion 44 carried by the core 14 and a shell portion 46 carried by the shell 32. Also, each seal 22 may include one or more closed tubular inserts 48 generally disposed between the core portion 44 and the core 14, preferably within one or more of the peripheral openings 42 to prevent flow of shell fluid into or out of the shell fluid passages at the seals 22.

Figure 7:
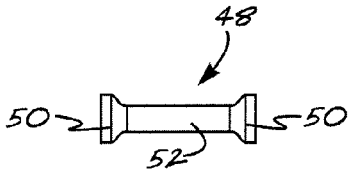
FIG. 7 is a top view of an exemplary third portion of the heat exchanger seal including one closed tubular insert of a plurality of closed tubular inserts.
Figure 8:
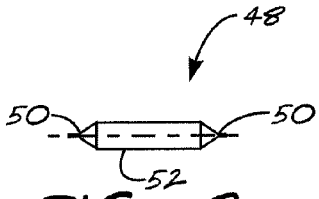
FIG. 8 is a side view of the closed tubular insert of FIG. 7.
Figure 9:
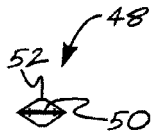
FIG. 9 is an end view of the closed tubular insert of FIG. 7.

Referring now to FIGS. 7 through 9, the tubular inserts 48 may be elongated and include collapsed ends 50 and a hollow body portion 52 between the collapsed ends 50. The tubular inserts 48 may be cut from tube stock, then collapsed, and thereafter crimped or welded at their ends 50 to sealingly close the tubular inserts 48. An exemplary tubular insert size may be about 0.25 inches in diameter and about 1.50 inches in length but those of ordinary skill in the art will appreciate that the sizes are application specific and depend on the spacing and length of the cassettes. The tubular inserts 48 may be hollow for good conformance when assembled to the core 14. A plurality of the tubular inserts 48 may be press-fit inserted between the cassettes 34 into corresponding peripheral openings 42 along a line corresponding to placement of the core portion 44 of the seal 22.

Figure 3:
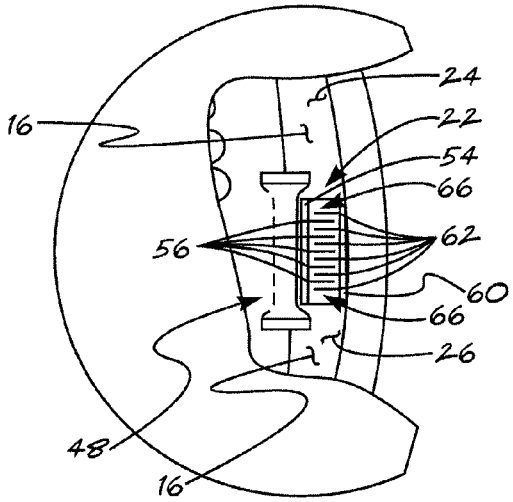
FIG. 3 is an enlarged fragmentary view of a portion of the heat exchanger of FIG. 1 showing one embodiment of an exemplary heat exchanger seal.

Referring to FIGS. 3 and 4, the core portion 44 of the seal 22 may include a base 54 adapted to be positioned against the periphery of the core 14 along the line of tubular inserts 48, and a plurality of fins 56 extending away from the base 54 from fixed ends attached to the base 54 toward free ends. The base 54 may include substantially opposite longitudinal ends 58, which may be attached in any suitable fashion to the end plates 36 of the core 14 such as via welding. The base 54 may be but is preferably not additionally welded to the cassettes 34 to avoid thermal stress on the plates 40. An exemplary width of the base 54 is about 1.00 inches, and about 0.06 inches in thickness. The fixed ends of the fins 56 may be tack welded to the base 54 along their length, but could be attached to the base 54 in any other suitable fashion. Moreover, the core portion 44 could instead be an extrusion having the fins 56 integral with the base 54. An exemplary size of the fins 56 is about 5/16 inches in width and about 0.02 inches in thickness but those of ordinary skill in the art will appreciate that the sizes are application specific and depend on the dimension of the fluid gap 16. The length of the core portion 44 generally depends on the length of the core 14, which size varies depending on the particular application for the heat exchanger 10.

Figure 5:
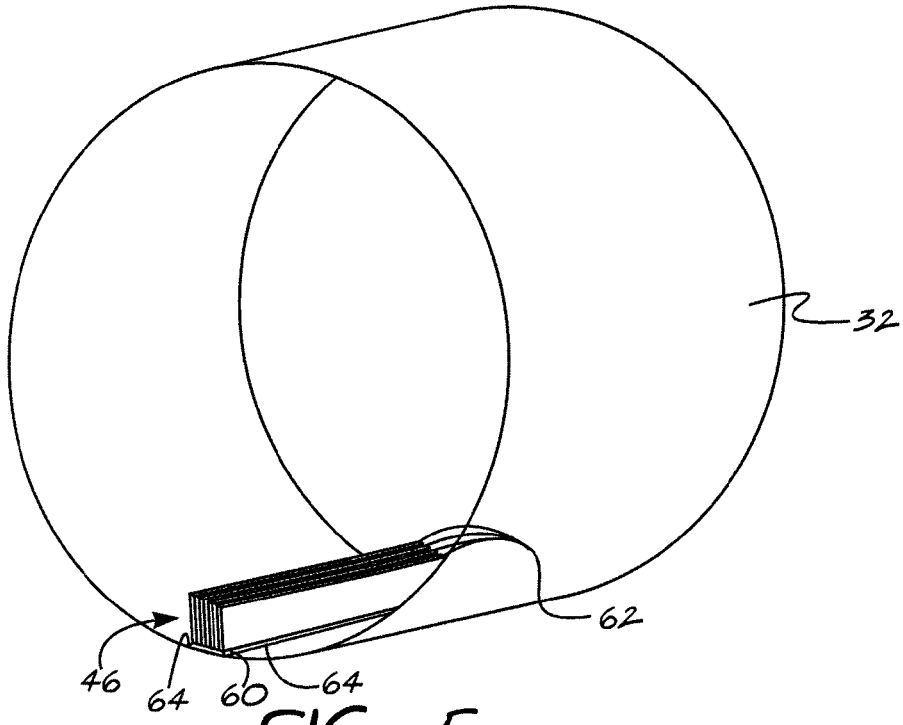
FIG. 5 is an upper perspective view of an exemplary shell of the heat exchanger of FIG. 1, showing an exemplary second portion of the heat exchanger seal.

Referring to FIG. 5, the shell portion 46 of the seal 22 may include a base 60 adapted to be positioned against an inside surface of the shell 32, and a plurality of fins 62 extending away from the base 60 from fixed ends attached to the base 60 toward free ends. The base 60 may include substantially opposite sides 64, which may be attached in any suitable fashion to the shell 32 such as via welding. An exemplary width of the base 60 is about 1.00 inches, and about 0.06 inches in thickness. The fixed ends of the fins 62 may be tack welded to the base 60 along their length, but could be attached to the base 60 in any other suitable fashion. Moreover, the shell portion 46 could instead be an extrusion having the fins 62 integral with the base 60. An exemplary size of the fins 62 is about 5/16 inches in width and about 0.02 inches in thickness but those of ordinary skill in the art will appreciate that the sizes are application specific and depend on the dimension of the fluid gap 16. The length of the shell portion 46 generally depends on the length of the shell 32, which size varies depending on the particular application for the heat exchanger 10.

As shown in FIG. 3, the seal fins 56, 62 are interleaved and their free ends are spaced apart from their respectively opposed base portions 60, 54 to define a circumferentially open labyrinth seal having open circumferential sides 66. The free ends of the fins 56, 62 may be spaced, for example, about 1/16 inches from respective opposed bases 54, 60. The seals 22 may, but preferably do not, have metal-to-metal contact to enable easy assembly of the heat exchanger 10. Thus, the seals 22 may be axial, or axially oriented, labyrinth seals that baffle or offer resistance to fluid flow therethrough, wherein the resistance is higher than resistance to flow through the shell fluid passages. In other words, the seals 22 present a hydraulic obstacle that diverts fluid to proceed through the core 14. Alternatively, the longitudinally extending labyrinth seals 22 could be helically disposed, or angled, with respect to the longitudinal axis of the core 14.

The various components of the heat exchanger 10 may be composed of any suitable material(s) like any suitable metal (s) such as steel and/or aluminum, or any other suitable material(s). Also, the heat exchanger 10 may be produced in any suitable manner including the following exemplary steps. First, the plates 40 are welded together to define the cassettes 34, which are then welded together to partially define the core 14. Second, the nozzles or fittings 18 are welded to the core end plates 36, between which the stack of cassettes 34 is placed. Third, the cassettes 34 and plates 40 are compressed and the tie straps 38 are welded to the end plates 36 to hold compression of the core 14. Fourth, the core portion 44 and shell portion 46 of the seal 22 are constructed by tack welding the fins 56, 62 to their respective bases 54, 60. Fifth, the tube inserts 48 are crimped at their ends and inserted between the cassettes on opposite sides of the core 14. Sixth, the core portion 44 of the seal 22 is welded at the ends of its base 54 to the end plates 36 of the assembled core 14. Seventh, one of the cover plates 28, 30 is attached to the shell 32 in any suitable manner and the shell portion 46 of the seal 22 is attached to the inside wall of the shell 32 by tack welding the ends of its base 60 to the inside wall and welding along the sides of the base 60 to the inside wall. Eighth, the core 14 and the shell 32 are aligned for a concentric fit, with the fins 56, 62 of the core and shell portions 44, 46 being aligned and interleaved for easy insertion of the core 14 into the shell 32. Ninth, the other of the cover plates 28, 30 is attached to the shell 32. Tenth, the fittings 20 for the shell 32 are then aligned with apertures of the shell 32 and attached thereto.

FIGS. 10 through 15 illustrate another embodiment of an exemplary heat exchanger 110 for transfer of heat between different fluids. This embodiment is similar in many respects to the embodiment of FIGS. 1 through 9 and like numerals between the embodiments generally designate like or corresponding elements throughout the several views of the drawing figures. Additionally, the descriptions of the embodiments are incorporated by reference into one another and the common subject matter may generally not be repeated here.

Figure 10:
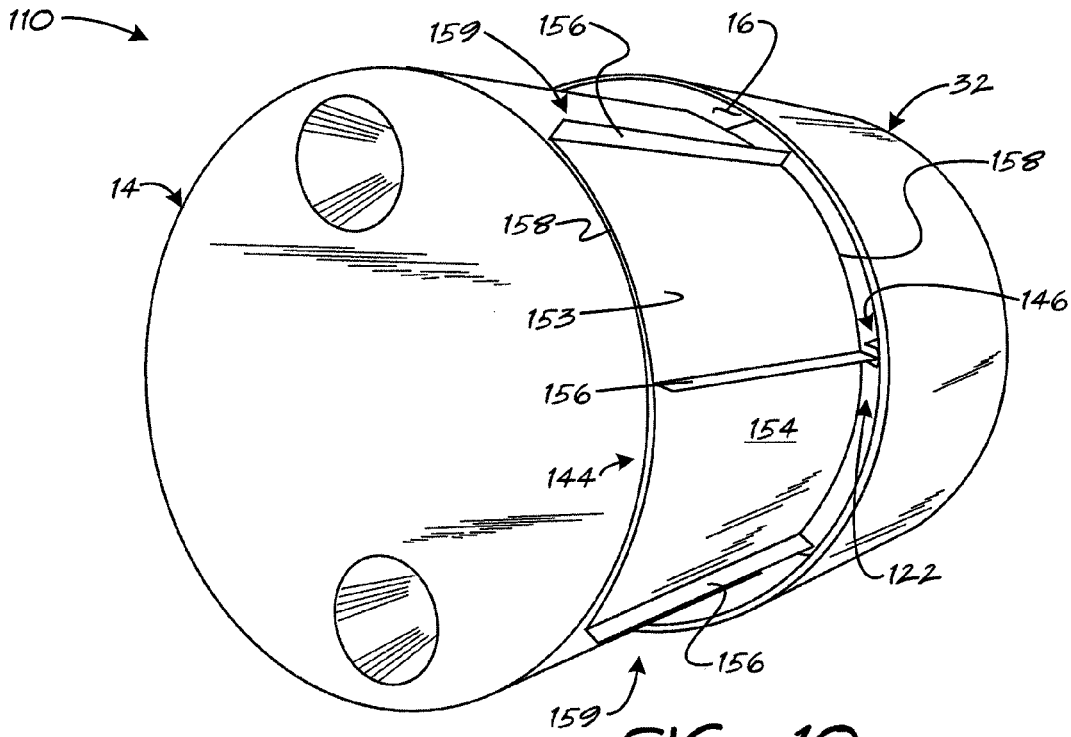
FIG. 10 is a partially exploded perspective view of another embodiment of an exemplary heat exchanger including another embodiment of an exemplary seal.

Referring to FIG. 10, the heat exchanger 110 includes the shell 32 having an inner periphery and at least partially surrounding the core 14 and at least partially defining the fluid gap 16 between the core 14 and the shell 32. The heat exchanger 110 also includes oppositely disposed seals 122 (one shown), that each may include a core portion 144 carried by the core 14 and a shell portion 146 carried by the shell 32 for cooperation with the core portion 144.

Figure 11:
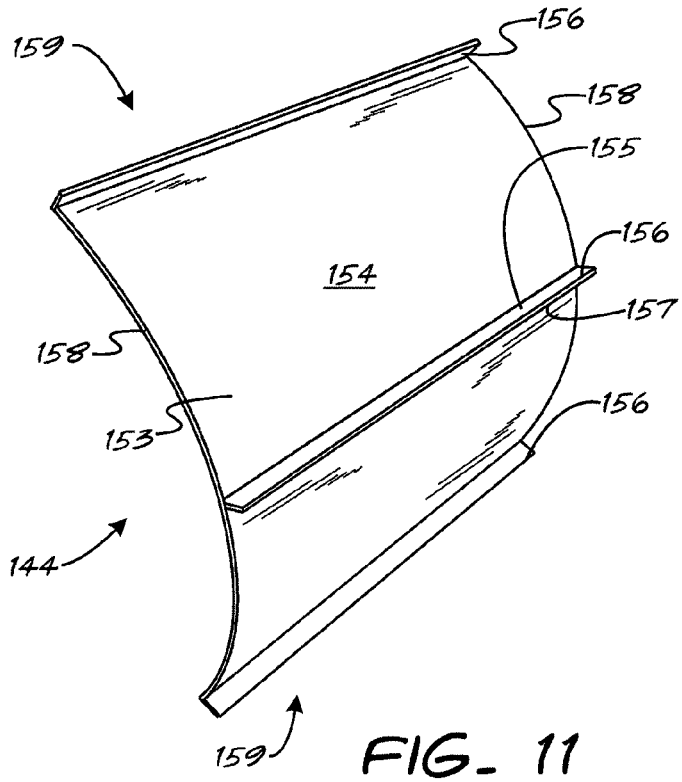
FIG. 11 is a perspective view of a flow diverter of the heat exchanger of FIG. 10, illustrating longitudinally extending and radially projecting core seal members.

As best shown in FIG. 11, the core portion 144 of the seal 122 includes a flow diverter 154 that may be of generally semi-cylindrical shape to substantially conform to the outer periphery of the core 14. The flow diverter 154 may include a curved base plate 153 and one or more core seal members such as fins 156 generally extending longitudinally along the base plate 153 and projecting radially away with respect to the core 14. The flow diverter 154 may be of any suitable size, for example, about 1-180 degrees in circumferential angular size between opposed sides 159 and substantially corresponding in length to the core 14 between opposed ends 158. The base 153 may be carried by the core 14 in any suitable manner, such as by welding, fastening, or otherwise attaching the base 153 to the end plates (not shown) of the core 14.

The core fins 156 may be located substantially at the sides 159 and in the center of the diverter 154 as shown, or in any other suitable locations and in any quantity desired. The core fins 156 may include fixed ends 155 proximate the outer periphery of the core 14 that, for example, may be welded, fastened, or otherwise attached to the base 153 of the diverter 154. The core fins 156 may also terminate in free ends 157 substantially opposite the fixed ends 155 and distal the outer periphery of the core 14. Thus, the core fins 156 may project generally radially outwardly with respect to the core 14.

The core fins 156 also or instead may be integrally formed with the base plate 153 of the diverter 154. For example, the fins 156 at the sides 159 of the diverter 154 may be folded or bent portions of the base plate 153, and the fin 156 at the center of the diverter 154 may be a bent or buckled portion of the base plate 153.

Figure 12:
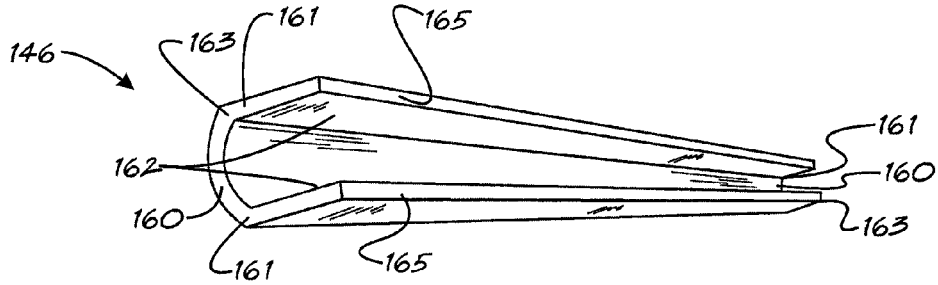
FIG. 12 is a perspective view of a longitudinally extending shell seal member of the heat exchanger of FIG. 10.
Figure 13:
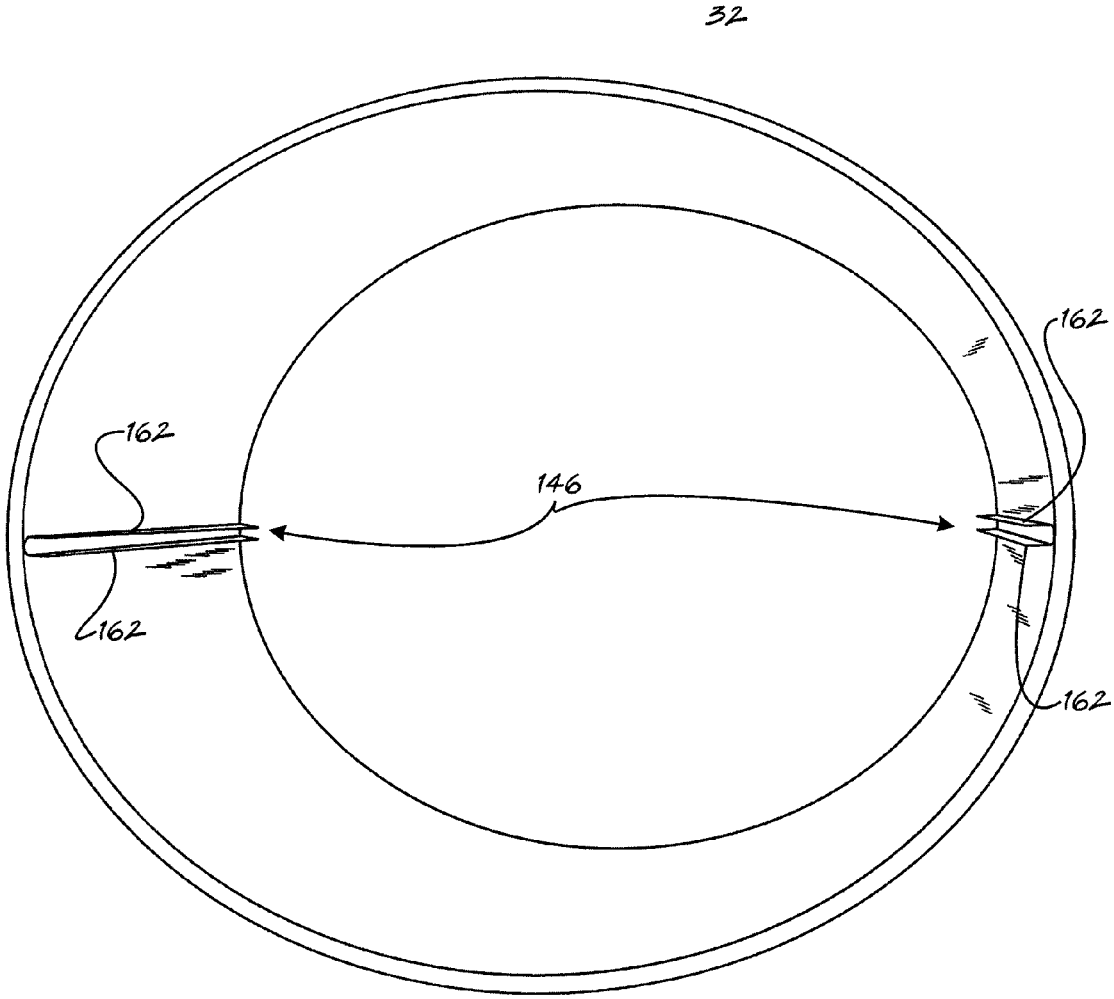
FIG. 13 is a perspective view of a heat exchanger shell including a plurality of the seal member of FIG. 12 carried by the shell and projecting radially inwardly.

As best shown in FIGS. 12 and 13, the shell portion 146 may be of generally U-shape and carried by the inner periphery of the shell 32 (FIG. 13). The shell portion 146 may be carried by the shell 32 in any suitable manner, such as welding, fastening, or any other suitable attachment. The shell portion 146 may include one or more shell seal members such as shell fins 162 generally extending longitudinally along the shell 32 and projecting radially away with respect thereto. The shell portion 146 may be of any suitable size, for example, about 0 to 10 degrees in circumferential angular size and substantially corresponding in length to the shell 32 between opposed ends 163. The shell fins 162 may include fixed ends 161 proximate the inner periphery of the shell 32 that, for example, may be welded, fastened, or otherwise attached to the shell 32 or may be integral with a shell base 160 that may be welded, fastened, or otherwise attached to the shell 32. The shell fins 162 may also terminate in free ends 165 substantially opposite the fixed ends 161 and distal the inner periphery of the shell 32.

The shell fins 162 also or instead may be integrally formed with the shell 32. For example, the shell fins 162 may be a bent or buckled portion of the shell 32 itself. The shell fins 162 may be located substantially at opposed sides of the shell 32 as shown in FIG. 13, or in any other suitable locations and in any quantity desired.

Figure 14:
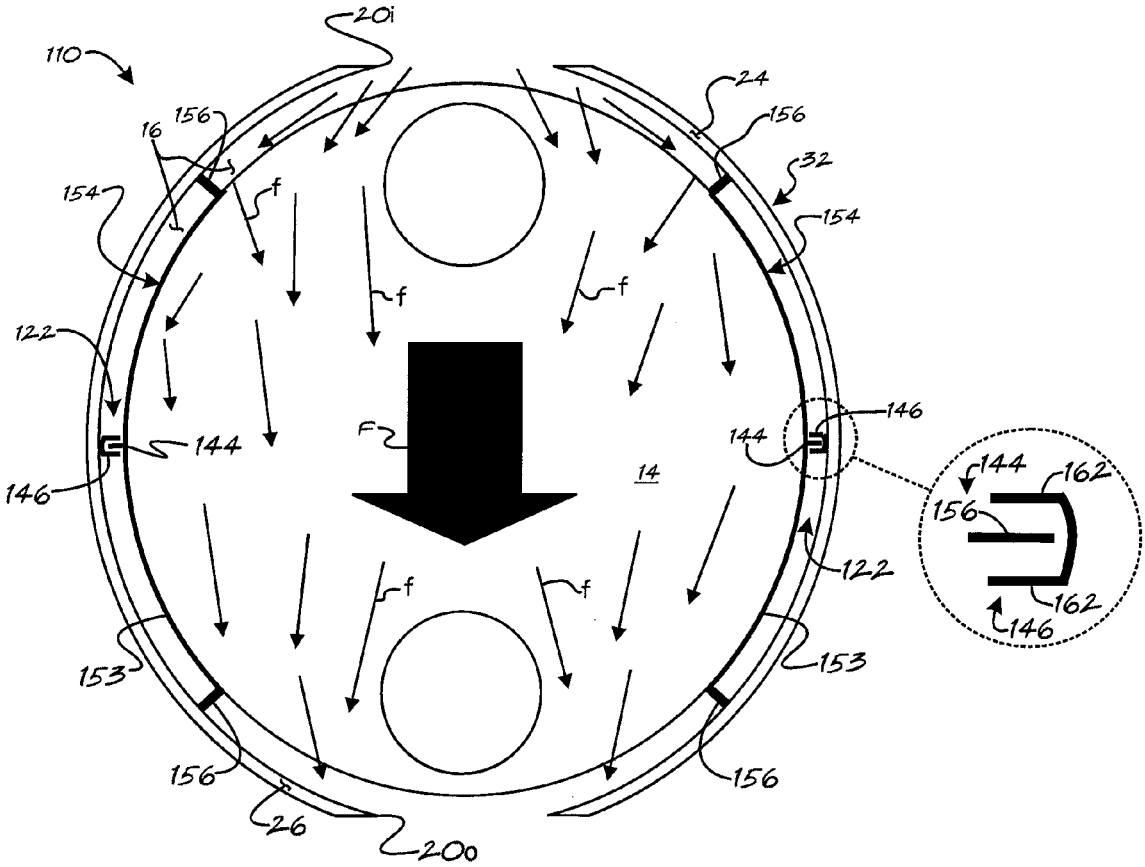
FIG. 14 is a schematic transverse sectional view of the heat exchanger of FIG. 10, illustrating a working fluid flowing transversely through a plate stack.

Referring to FIG. 14, the shell fins 162 are interleaved with the corresponding core fin 156, and the other core fins 156 project into the fluid gap 16. The fins 156, 162 may be interleaved in any suitable manner, including a loose fit, an interference fit, or any other desired fit between the core 14 and the shell 32. Thus, the seals 122 between the shell 32 and the core 14 at least partially divide the fluid gap 16 into the inlet and outlet chambers 24, 26.

Accordingly, fluid f, F flows into the heat exchanger 110 through an inlet opening 20*i* through the shell 32 and into the inlet chamber 24 defined in the fluid gap 16 between the shell 32 and the core 14. The seals 122 help ensure that the fluid f, F does not bypass the core 14 by flowing around the outer periphery of the core 14 in the fluid gap 16. Rather, the fluid f, F may be diverted out of the inlet chamber 24 and into the core 14 by the core fins 156 at the (upstream) sides of the flow diverters 154. Also, the fluid f, F is substantially prevented from flowing around the core 14 by the cooperation of the core and shell portions 144, 146 of the seals 122. The fluid f, F flows out of the core 14, into the outlet chamber 26. The fluid f, F may again be diverted by the flow diverters 154, this time by the core fins 156 at the (downstream) sides of the diverters 154 out of an outlet opening 20*o* of the heat exchanger 110.

Figure 15:
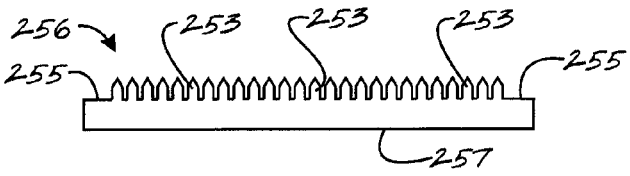
FIG. 15 is a side view of a comb for the flow diverter of FIG. 1.
Figure 16:
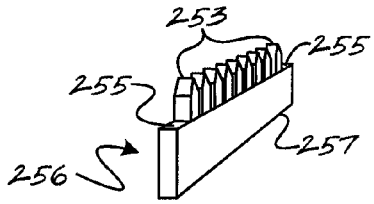
FIG. 16 is a perspective view of the comb of FIG. 15.

Referring to FIGS. 15 and 16, an alternative core fin 256 is shown and includes a fixed end 255 and a free end 257. The core fin 256 may be comb shaped wherein the fixed end 255 may include a plurality of projections 253 that may be longitudinally spaced apart and adapted to be radially engaged to corresponding portions of the core 14. More specifically, the projections 253 may be inserted between the stacked plates of the core 14 and/or in openings thereof for particularly good securing and sealing of the core fin 256 to the core 14.

While certain preferred embodiments have been shown and described, persons of ordinary skill in this art will readily recognize that the preceding description has been set forth in terms of description rather than limitation, and that various modifications and substitutions can be made without departing from the spirit and scope of the invention. By way of example without limitation, while the heat exchanger has been shown as being a generally cylindrical plate type device, it could be otherwise at tubular type device and/or box-shaped, rectangular, or of any other shape. The invention is defined by the following claims.

What is claimed is:

1. A stacked plate heat exchanger, comprising:

a core having an outer periphery and a longitudinal axis;

a shell having an inner periphery and at least partially surrounding the core to define a fluid gap between the shell and the core; and a seal disposed between the shell and the core to at least partially divide the fluid gap into an inlet chamber and an outlet chamber, wherein the seal comprises:

a core portion having a core base positioned adjacent to the periphery of the core and at least one core fin projecting radially outwardly with respect to the core and having at least one core fixed end attached to the core base and at least one core free end spaced from the base;

at least one shell fin projecting radially inwardly with respect to the shell and having at least one shell fixed end located adjacent to the inner periphery of the shell and at least one shell free end spaced from the inner periphery of the shell, and being interleaved with the at least one core fin, wherein the core and shell do not move relative to each other once assembled and the seal extends along only a portion of the fluid gap between the shell and core so that fluid may flow within the fluid gap around a least a portion of the periphery of the core without obstruction by the seal; and at least one insert disposed between the core base and the core to limit fluid flow between the core and the core base, and wherein the core base is semi-cylindrical and includes longitudinally extending sides and at least one additional core fin projecting radially outwardly with respect to the core and having at least one fixed end proximate the outer periphery of the core and at least one free end distal the outer periphery of the core.

2. The heat exchanger of claim 1, wherein the at least one additional core fin includes a plurality of spaced projections that engage the core.

3. A stacked plate heat exchanger, comprising:

a core having an outer periphery and a longitudinal axis;

a shell having an inner periphery and at least partially surrounding the core to define a fluid gap between the shell and the core; and a seal disposed between the shell and the core to at least partially divide the fluid gap into an inlet chamber and an outlet chamber, wherein the seal comprises:

a core portion having a core base positioned adjacent to the periphery of the core and at least one core fin projecting radially outwardly with respect to the core and having at least one core fixed end attached to the core base and at least one core free end spaced from the base;

at least one shell fin projecting radially inwardly with respect to the shell and having at least one shell fixed end located adjacent to the inner periphery of the shell and at least one shell free end spaced from the inner periphery of the shell, and being interleaved with the at least one core fin, wherein the core and shell do not move relative to each other once assembled and the seal extends along only a portion of the fluid gap between the shell and core so that fluid may flow within the fluid gap around a least a portion of the periphery of the core without obstruction by the seal; and at least one insert disposed between the core base and the core to limit fluid flow between the core and the core base, and wherein said at least one insert is tubular, is disposed between the core base and the core and has closed ends to prevent fluid flow through the insert.

4. The heat exchanger of claim 3, wherein the core base includes a width and the at least one tubular insert includes collapsed ends and a body portion therebetween having a width substantially corresponding to the width of the core base.

5. A stacked plate heat exchanger, comprising:

a core of substantially cylindrical shape and including a longitudinally extending stack of corrugated plates with a plurality of outlet openings defined between at least some of the plates at the periphery of the plates;

a shell of substantially hollow cylindrical shape at least partially surrounding the core, wherein a fluid gap is defined between the shell and the core and wherein the fluid gap includes the outlet openings;

a labyrinth seal disposed in the fluid gap and projecting radially between and extending longitudinally along the stack and the shell to at least partially divide the fluid gap into an inlet chamber and an outlet chamber;

at least one insert at least partially received in at least one outlet opening between the seal and core, wherein the seal comprises:

an elongate core base, a plurality of core fins extending longitudinally along and projecting radially outwardly from the core base, an elongate shell base, and a plurality of shell fins extending longitudinally along and projecting radially inwardly from the shell base, and being interleaved with the plurality of core fins, and wherein the seal further comprises at least one tubular insert having a hollow body and closed ends that is disposed longitudinally between adjacent plates of the stack and radially between the core base and the stack.

6. The heat exchanger of claim 5, wherein the core base includes a width and the at least one tubular insert includes collapsed ends and a body portion therebetween having a width substantially corresponding to the width of the core base.

7. The heat exchanger of claim 5, wherein the stack further includes end plates and the core base is attached to the end plates.

8. The heat exchanger of claim 5, wherein the plurality of core fins include free ends that are radially spaced from the shell base, and the plurality of shell fins include free ends that are radially spaced from the core base to define a circumferentially open labyrinth.

* * * * *